US005780785A

United States Patent [19]

Eckel

[11] Patent Number: 5,780,785

[45] Date of Patent: Jul. 14, 1998

[54] ACOUSTIC ABSORPTION DEVICE AND AN ASSEMBLY OF SUCH DEVICES

[76] Inventor: Alan Eckel, 10 Hildreth St., Westford, Mass. 01886

[21] Appl. No.: 815,883

[22] Filed: Mar. 12, 1997

[51] Int. Cl.[6] ..... E04B 1/82

[52] U.S. Cl. ..... 181/295; 181/285

[58] Field of Search ..... 181/30, 284, 286, 181/287, 290, 291, 293, 295; 342/1–4

[56] References Cited

U.S. PATENT DOCUMENTS

| | | | |
|---|---|---|---|
| 2,980,198 | 4/1961 | Eckel . | |
| 3,086,325 | 4/1963 | Eckel | 181/290 |
| 3,136,397 | 6/1964 | Eckel . | |
| 3,146,498 | 9/1964 | Eckel . | |
| 3,295,133 | 12/1966 | Emerson et al. . | |
| 3,410,363 | 11/1968 | Schwartz . | |
| 3,421,273 | 1/1969 | Eckel | 181/290 |
| 3,712,413 | 1/1973 | Eckel . | |
| 3,735,837 | 5/1973 | Duda et al. . | |
| 4,362,222 | 12/1982 | Hellstrom . | |
| 4,387,786 | 6/1983 | Klipsch et al. . | |
| 4,477,505 | 10/1984 | Warnaka . | |
| 4,605,093 | 8/1986 | Karlen . | |
| 4,883,143 | 11/1989 | Lagier . | |
| 5,016,185 | 5/1991 | Kuester et al. . | |
| 5,141,073 | 8/1992 | Penolis | 181/30 |
| 5,317,113 | 5/1994 | Duda | 181/295 X |
| 5,331,567 | 7/1994 | Gibbons et al. . | |

OTHER PUBLICATIONS

Lynde et al. "Development Of An Alternative Metal Anechoic Wedge", Sound and Vibration, Oct. 1993, pp. 6, 8, 10, 12, 14 and 16.

L.L. Beranek et al. "The Design and Construction of Anechoic Sound Chambers", J. Acous. Soc. of America, vol. 18, No. 1, pp. 140–150, Jul. 1946.

B.G. Watters, "Design of Wedges for Anechoic Chambers", NOISE Control, pp. 368–373, Nov. 1958.

*Primary Examiner*—Khanh Dang
*Attorney, Agent, or Firm*—Pandiscio & Pandiscio

[57] ABSTRACT

An acoustic absorption device preferably includes a platform having a rectangularly-shaped top surface and four side surfaces, each of the surfaces comprising a perforated material. A plurality of spires upstand from the top surface, the spires extending from a first to an opposite second of the sides. A first of the spires is provided with a wall surface comprising a continuation of a third of the platform side surfaces to form a device first planar end, and a second of the spires is provided with a wall surface comprising a continuation of a fourth of the platform side surfaces to form a device second planar end. The spires are spaced one from another to form a channel therebetween. The spires are at least in part covered with the perforated material. The platform and the spires each house a body of sound absorbing material.

26 Claims, 5 Drawing Sheets

ACOUSTIC ABSORPTION DEVICE AND AN ASSEMBLY OF SUCH DEVICES

FIELD OF THE INVENTION

The invention relates to sound absorption devices and is directed more particularly to such devices for use in constructing anechoic chambers.

BACKGROUND OF THE INVENTION

An anechoic chamber is a room that is used for precise acoustical measurements. Therefore, the room must be designed so that acoustically free field conditions exist. For practical measurements, the room also must be free of extraneous noise interferences. Anechoic chambers are widely used in the development of quieter products, including automotive and aircraft products and other products for use in transportation, communications, computers, security, and medical research.

An acoustical free field exists in a homogeneous, isotropic medium which is free of reflecting boundaries. In an ideal free field environment, the inverse square law would function perfectly, so that the sound pressure level generated by a spherically radiating sound source decreases approximately six decibels (6 dB) for each doubling of the distance from the source. A room or enclosure designed and constructed to provide such an environment is called an anechoic chamber.

Also usually an anechoic chamber must provide an environment with controlled sound pressure ($L_p$) free from excessive variations in temperature, pressure and humidity. Outdoors, local variations in these conditions, as well as wind and reflections from the ground, can significantly and unpredictably disturb the uniform radiation of sound waves. This means that a true acoustical free field is only likely to be encountered inside an anechoic chamber. For an ideal free field to exist with perfect inverse square law characteristics, the boundaries must have a sound absorption coefficient of unity at all angles of incidence.

Anechoic chambers are characterized by anechoic elements that are attached to the walls, ceiling and floor of the chamber. If the anechoic elements are attached to the walls and ceiling but not the floor of the chamber, the chamber is termed a hemi-anechoic chamber. Such chambers also are used for acoustical measurements. The anechoic elements may be attached so that they are essentially in contact with or spaced from the supporting walls, ceiling and floor, depending on what is considered to be the optimum design for the chamber based on its intended use.

An anechoic element is commonly defined as one which should have less than a 0.99 normal incidence sound absorption coefficient through the frequency range of interest. In such case, the lowest frequency in a continuously decreasing frequency sweep at which the sound absorption coefficient is 0.99 at normal incidence is defined as the cut-off frequency. Thus, in an anechoic chamber, 99% of the sound at or above the cut-off frequency is absorbed. For less than ideal conditions, different absorption coefficients may be established to define a cut-off frequency. Heretofore anechoic elements for anechoic chambers have commonly been designed in the shape of a wedge.

As already noted, a characteristic of a true free field is that the sound behaves in accordance with the inverse square law. In the manufacture of anechoic elements, those elements are tested in impedance tubes as a means for qualifying them for use in chambers simulating free field conditions. A fully anechoic chamber can also be defined as one whose deviations fall within a maximum of about 1–1.15 dB from the inverse square law characteristics, depending on frequency. According to currently accepted standards, semi-anechoic rooms or chambers, i.e., those with anechoic walls and ceilings but with acoustically reflective floors, e.g., floors made of concrete, asphalt, steel, or other metals or materials, can deviate from the inverse square law by a maximum of about 3 dB depending on frequency.

Because of the very high degree of sound absorption required in an anechoic chamber, conventional anechoic elements typically comprise sound absorptive material covered or contained by a cage or cover that is made of a wire cloth (mesh) or a perforated sheet metal. For many years most anechoic elements embodied a wire mesh cage that typically was characterized by a 90–95% open area to allow maximum exposure of sound absorbing material to the sound waves. More recently the wire mesh covering has been replaced by a perforated sheet metal, with the an open area provided by the perforations falling within a relatively wide range; usually the open area falls within the range of about 23% to about 52% (or greater) of the entire area of the sheet metal covering.

The earliest practical design for sound absorbing units of the type used in making anechoic chambers was a wedge-shaped unit fabricated from or comprising fibrous glass. That geometry of anechoic wedges has been employed as the basis for anechoic chamber design and construction over the last fifty years. Examples of prior art anechoic elements and chambers made using such elements are provided by U.S. Pat. Nos. 2,980,198, 3,421,273, and 5,317,113, and the technical publications by L. L. Beranek et al, "The Designs And Construction of Anechoic Sound Chambers", J. Acous. Soc. of America, Vol. 18, No. 1, pp.140–150, July 1946; and B. G. Watters, "Design of Wedges For Anechoic Chambers", Noise Control, pp. 368–373, November 1958.

The cross-section of the conventional wedge shaped anechoic element consists of a square or rectangular base, with two opposite side surfaces of the element tapering to a line junction with one another. The length of the wedge unit, i.e., the distance measured from the line junction to the base, varies according to the low frequency cutoff desired in the chamber. The lower the low frequency cut-off, the longer the wedge unit or overall depth of treatment required to create an anechoic environment. Typically, a quarter wave length of the desired low frequency cutoff approximates the overall depth of treatment that is required to create an anechoic environment in a test chamber. The depth of treatment is determined by the geometry of the anechoic wedge and the wall of the sound attenuating structure. Heretofore, the wedge shape has been considered the optimum geometric design for sound absorbing units. Various combinations of wedge taper, size, and air gap (if any) between the anechoic element and the supporting wall structure may be required in order to achieve the proper depth of treatment for various low frequency cut-offs.

In addition to the shape of the anechoic wedge unit, both the flow resistance of that wedge unit and the sound absorbing material of which the wedge is constructed are critical to the performance of the wedge-shaped anechoic elements and the chamber that employs same.

Over the past 50 years, there have been a number of changes in the design and construction of units used in the construction of anechoic wedge chambers. These changes have included changes in the sound absorbing materials, along with different protective coverings and support systems. Wedges fabricated from polyether or polyester open cell foams, e.g., polyurethane foams, have on occasion been substituted for the traditional fiberglass.

U.S. Pat. No. 5,317,113, issued to Duda, shows that the wedges may have wall members made of a perforated sheet metal adjacent to sound absorbing members and that such wedges offer the advantage of producing satisfactory sound transparency coupled with protection of sound absorbing material.

It is believed that the traditional wedge-shaped sound absorbing elements have been refined to the point at which little additional advantage can be expected to be forthcoming from continued refinement. There is a need for sound absorbing units which afford improved sound absorption while providing a new geometric capacitation that reduces the overall depth of treatment, required to achieve a desired low frequency cut off.

SUMMARY OF THE INVENTION

This invention relates to improved sound absorbing devices for use in constructing anechoic chambers. As used herein, the term "anechoic chamber" is intended to include hemi-anechoic chambers, and also the term "semi-anechoic chambers" is intended to include and be synonymous with "hemi-anechoic chambers".

A primary object of the invention is to provide a new acoustic absorption device for use in constructing anechoic chambers that exhibit a maximum deviation from the inverse square law in the range of 1.5 to 3 dB, depending on frequency.

A further object of the invention is to provide an assembly of improved sound absorption devices so as to form an improved anechoic chamber.

Another object is to provide sound absorbing units which offer desired sound absorption, at least in part by exposing more surface area than conventional wedge-shaped units used in construction of anechoic test chambers.

With the above and other objects in view, as will hereinafter appear, a feature of the present invention is the provision of an acoustic absorption device comprising a platform having a rectangularly-shaped top surface and four side surfaces, each of the surfaces comprising a perforated sheet material. Two or more spires upstand from the top surface. A first of the spires is provided with a wall surface comprising a continuation of a third of the platform side surfaces to form a device first planar end, and a second of the spires is provided with a wall surface comprising a continuation of a fourth of the platform side surfaces to form a device second planar end. The spires are spaced one from another to form channels therebetween. The spires are at least in part covered with the perforated material. The platform and the spires each house a body of sound absorbing material.

In accordance with a further feature of the invention, there is provided an assembly of acoustic absorption devices. Each of the devices comprises a platform having a rectangularly-shaped top surface and four side surfaces, each of the surfaces comprising a perforated material. A plurality of spires upstand from the top surface, the spires extending from a first to an opposite second of the sides, a first of the spires having a wall surface comprising a continuation of a third of the platform side surfaces to form a device first planar end, and a second of the spires having a wall surface comprising a continuation of a fourth of the platform side surfaces to form a device second planar end, the spires being spaced one from another to form channels therebetween. The spires are at least in part covered with the perforated material. The platform and the spires each house a body of sound absorbing material. The assembly further includes a wall for supporting a multiplicity of the devices, the devices being arranged on the wall with the platforms thereof adjacent the wall and the spires extending normal to the wall. A first device first and second planar ends each abut one of the first and second sides of another of the devices, and the first device first and second sides each abut one of the device first and second planar ends of another of the devices.

The above and other features of the invention, including various novel details of construction and combination of parts, will now be more particularly described with reference to the accompanying drawings and pointed out in the claims. It will be understood that the particular devices embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENTS

Figure 1:
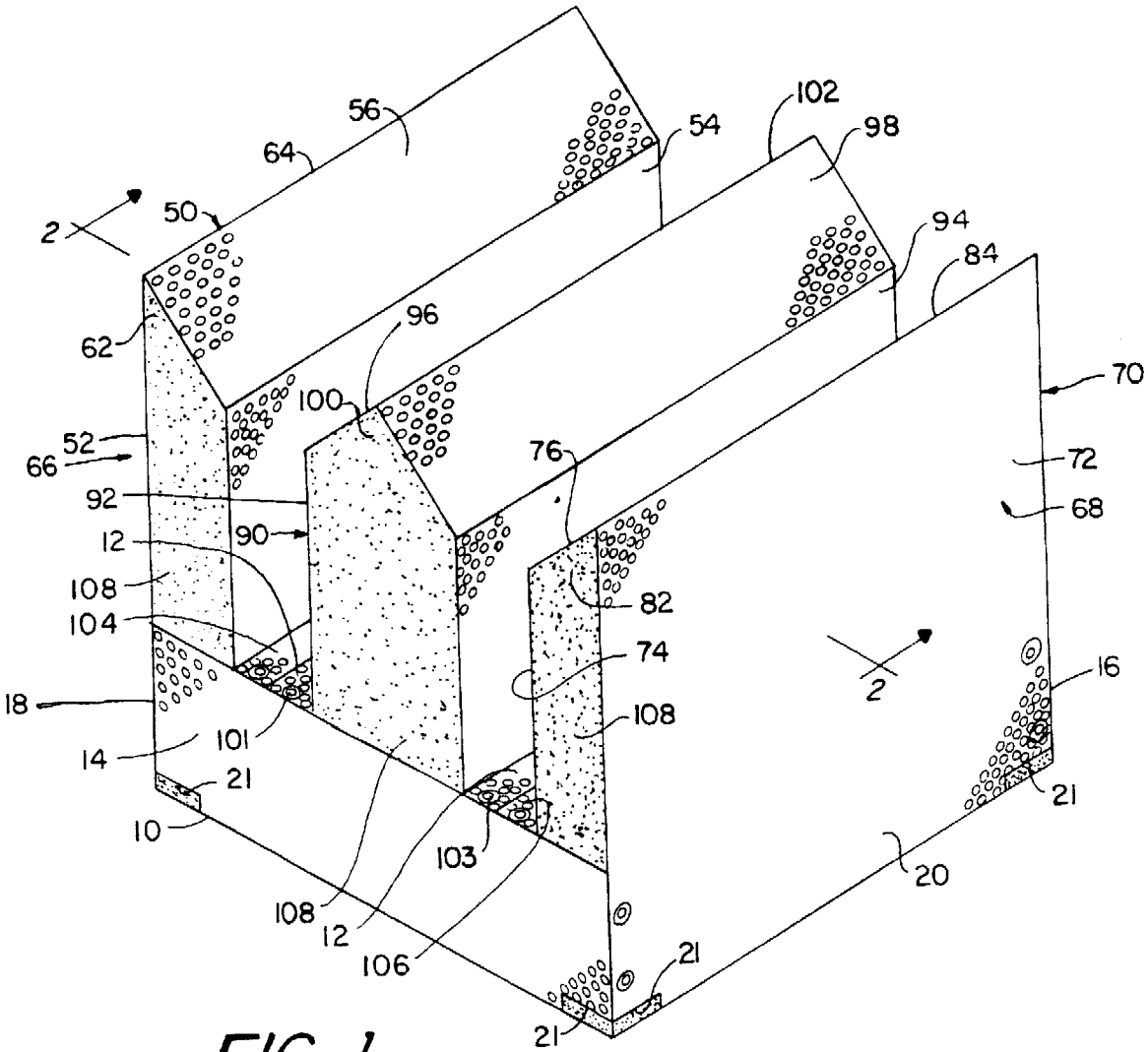
FIG. 1 is a perspective view of one form of acoustic absorbing device illustrative of an embodiment of the invention.
Figure 2:
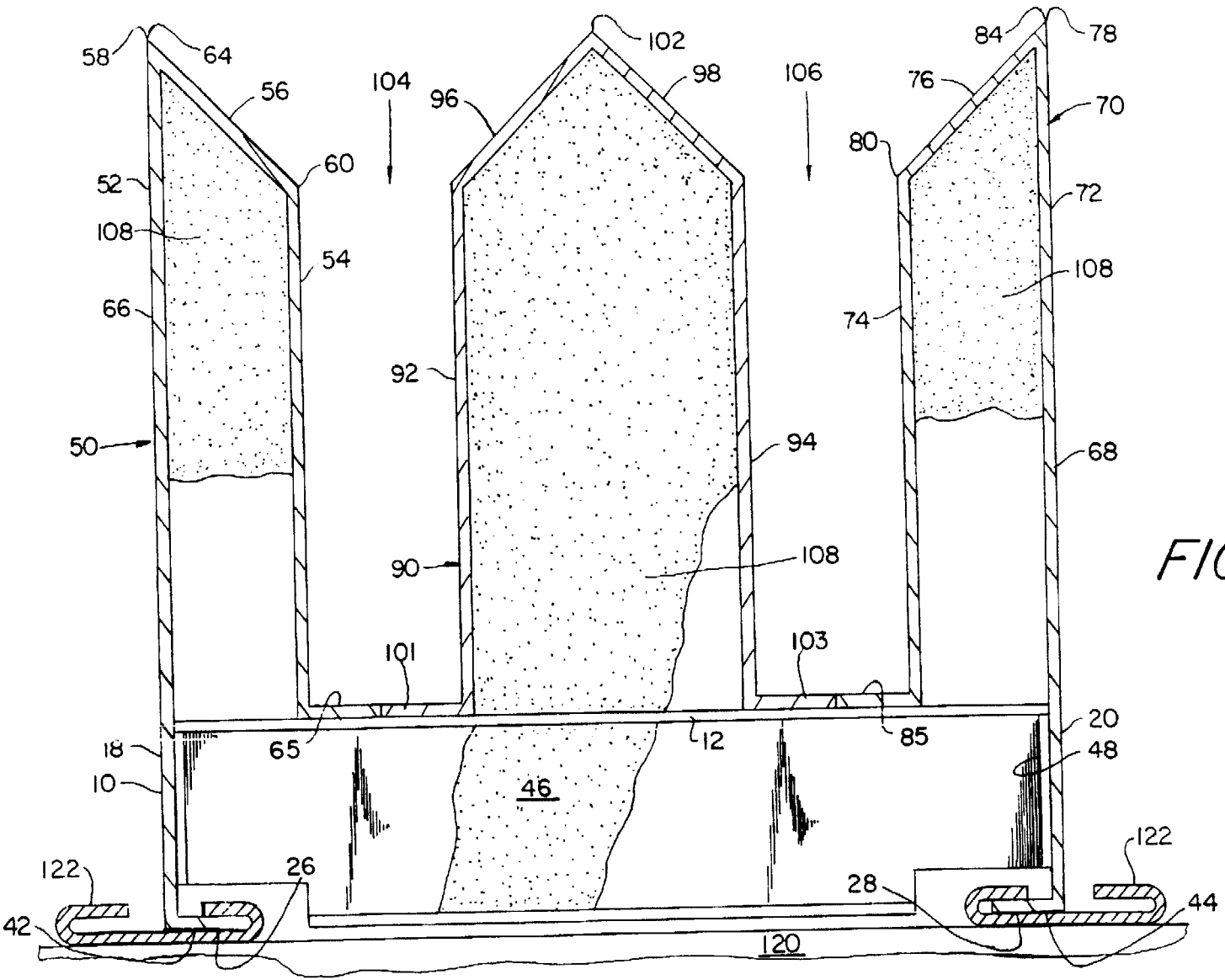
FIG. 2 is a sectional view taken along line 2—2 of FIG. 1, with portions of the sound absorbing material removed for illustrative purposes, the device being shown with a wall adapted to receive and retain the devices of FIG. 1.
Figure 3:
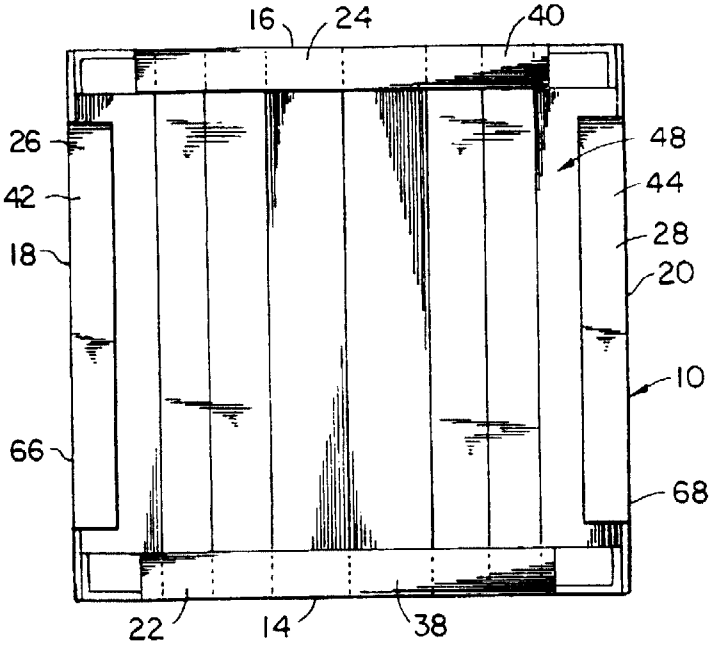
FIG. 3 is bottom plan view of the device of FIG. 1.

Referring to FIGS. 1–3, it will be seen that an illustrative sound absorbing device or unit includes a 3-dimensional "E"-shaped element having a rectangularly-shaped platform or base 10 having a top surface or wall 12, a first side surface or wall 14, a second side wall or surface 16, a third side wall or surface 18, and a fourth side wall or surface 20. The walls 12, 14, 16, 18 and 20 are all flat and each comprises a perforated sheet material that preferably is rigid and made of metal.

Figure 4:
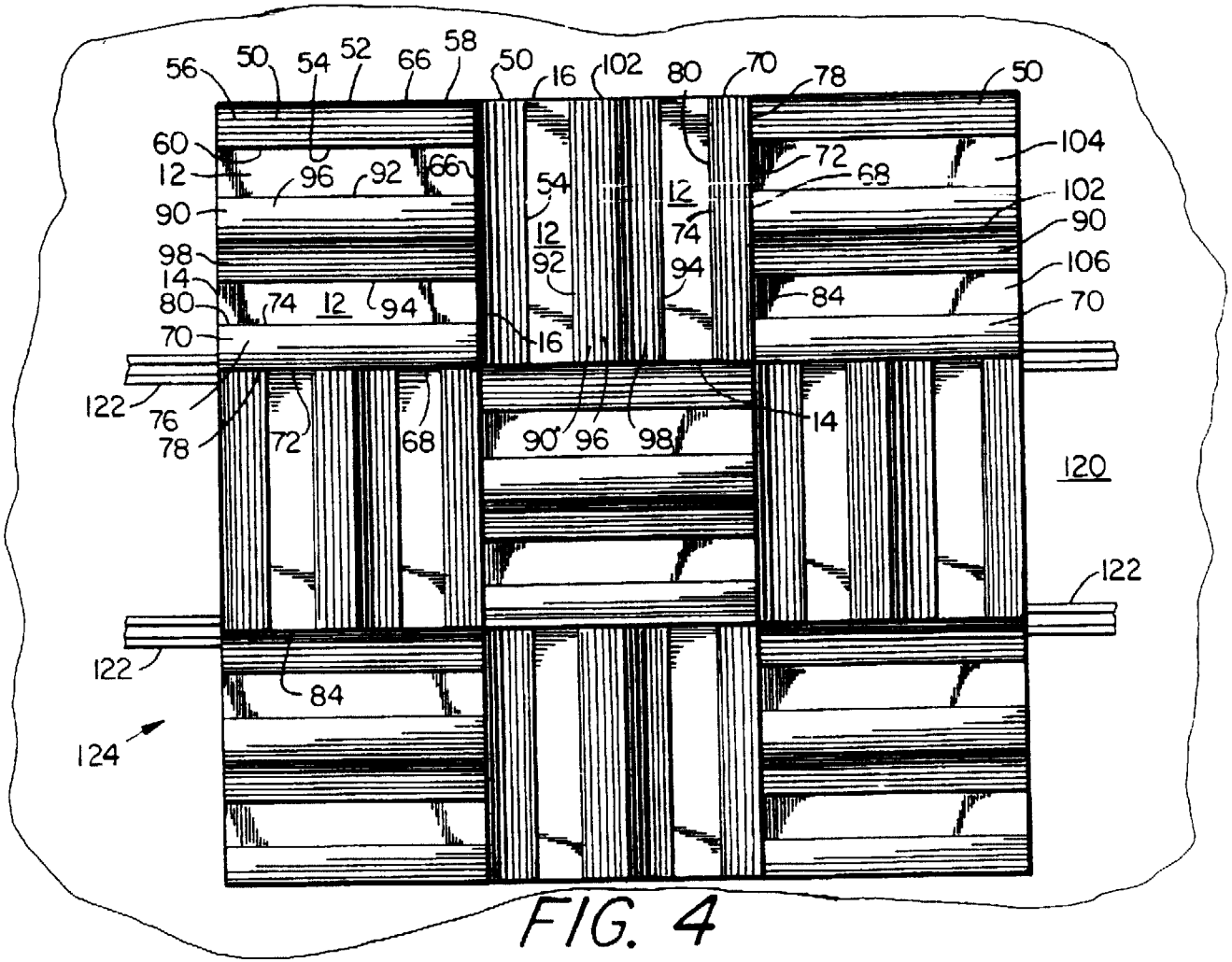
FIG. 4 is a top plan view of a wall of an anechoic chamber lined with a plurality of the devices of FIG. 1.

Referring to FIG. 3, it will be seen that the side walls 14, 16, 18 and 20 are provided with right angle flange portions 22, 24, 26 and 28, respectively, at their bottom edges. The flange portions 22, 24, 26 and 28 extend inwardly of the platform 10. Adjacent its bottom end each of the walls 14, 16, 18 and 20 is notched as shown at 21 (FIGS. 1–3) and additionally the flanges 22, 24, 26 and 28 are cut back at their appropriate ends congruently with notches 21, so that as shown in FIG. 4 the ends of the flanges terminate short of the adjacent corner of the platform 10. A body 46 of sound-absorbing material, such as a body of fiberglass or a foam elastomer, is disposed within the platform 10 and retained by the flange portions within the chamber 48 formed by top wall 12 and side walls 14, 16, 18, 20. While four flanges are not necessary, at least two flanges must be provided to retain the body 46 of sound absorbing material and to facilitate attachment of the unit to a wall, as will be described hereinbelow.

Returning to FIG. 1, it will be seen that a first side spire 50 is secured to and stands up from the top wall 12. An outer end side wall 52 of the first side spire 50 comprises a continuation of the platform side wall 18 to form a device first planar end wall 66. An inner side wall 54 of the first side spire 50 preferably is a rigid perforated sheet. A free end surface or wall 56 declines from an outer end of the outer end side wall 52 inwardly toward the inner side wall 54 and toward the top surface 12 to join the outer end of the first side spire inner side wall 54, thereby defining a peak 62 and a ridge 64 at the free end of the first side spire outer end side wall 52. Preferably, but not necessarily, wall 56 extends at an angle of approximately 45 degrees to walls 52 and 54. The bottom end of inner side wall 54 is formed with a right angle flange 65 that is welded to top wall 12.

Similarly, a second side spire 70 upstands from the top surface 12. An outer end side wall 72 of the second side spire 70 comprises a continuation of the platform side wall 20 to form a device second planar end wall 68. An inner side wall 74 of the second side spire 70 preferably is a rigid perforated sheet. A free end surface or wall 76 declines from the outer end of the second spire outer end side wall 72 inwardly toward the inner side wall 74 and toward the top surface 12 to join the outer end of the second side spire inner side wall 74, thereby defining a peak 82 and a ridge 84 at the free end of the second side spire outer end side wall 72. End wall 76 preferably is disposed at an angle of approximately 45 degrees to walls 72 and 74. The bottom end of side wall 74 is formed with a right angle flange 85 that is welded to top wall 12.

Referring still to FIG. 1, it will be seen that the illustrated device includes a central spire 90 upstanding from the platform top wall 12 and having parallel side walls 92, 94 of the aforementioned perforated sheet material. The central spire 90 extends parallel to first and second side spires 50, 70. The central spire 90 is provided with slanted end walls 96, 98 at the free end thereof, which join centrally of the free end to form a peak 100 and ridge 102. The bottom ends of walls 92 and 94 are formed with right angle flanges 101, 103 respectively that are welded to top wall 12. Preferably slanted walls 96, 98 extend at approximately a 45 degree angle to side walls 92 and 94.

Figure 5:
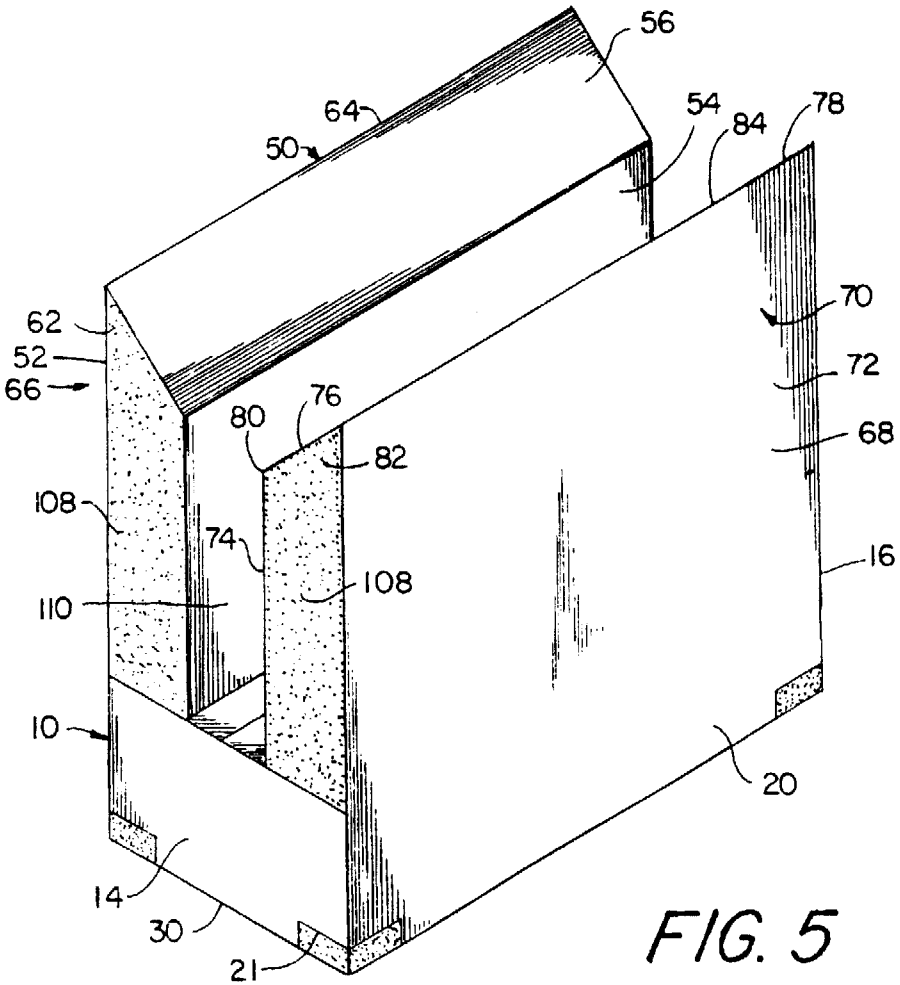
FIGS. 5 and 6 are perspective views of alternative embodiments of acoustic absorbing devices.

The central spire 90 is spaced from the first and second side spires 50, 70 to define first and second channels 104, 106 therebetween (FIG. 5). The spires 50, 70, 90 each house a body 108 of sound absorbing material like that which make up the body 46. It should be noted that at the sides corresponding to side walls 14 and 16 the sound-absorbing body 108 is not covered by any perforated material but instead is fully exposed to the environment.

Referring to FIG. 5, it will be seen that in an alternative embodiment, the device includes the aforementioned platform 10, and first and second side spires 50, 70, as described with respect to the embodiment shown in FIG. 1, but without the central spire 90. The side spires 50, 70 define therebetween a single channel 110.

Figure 6:
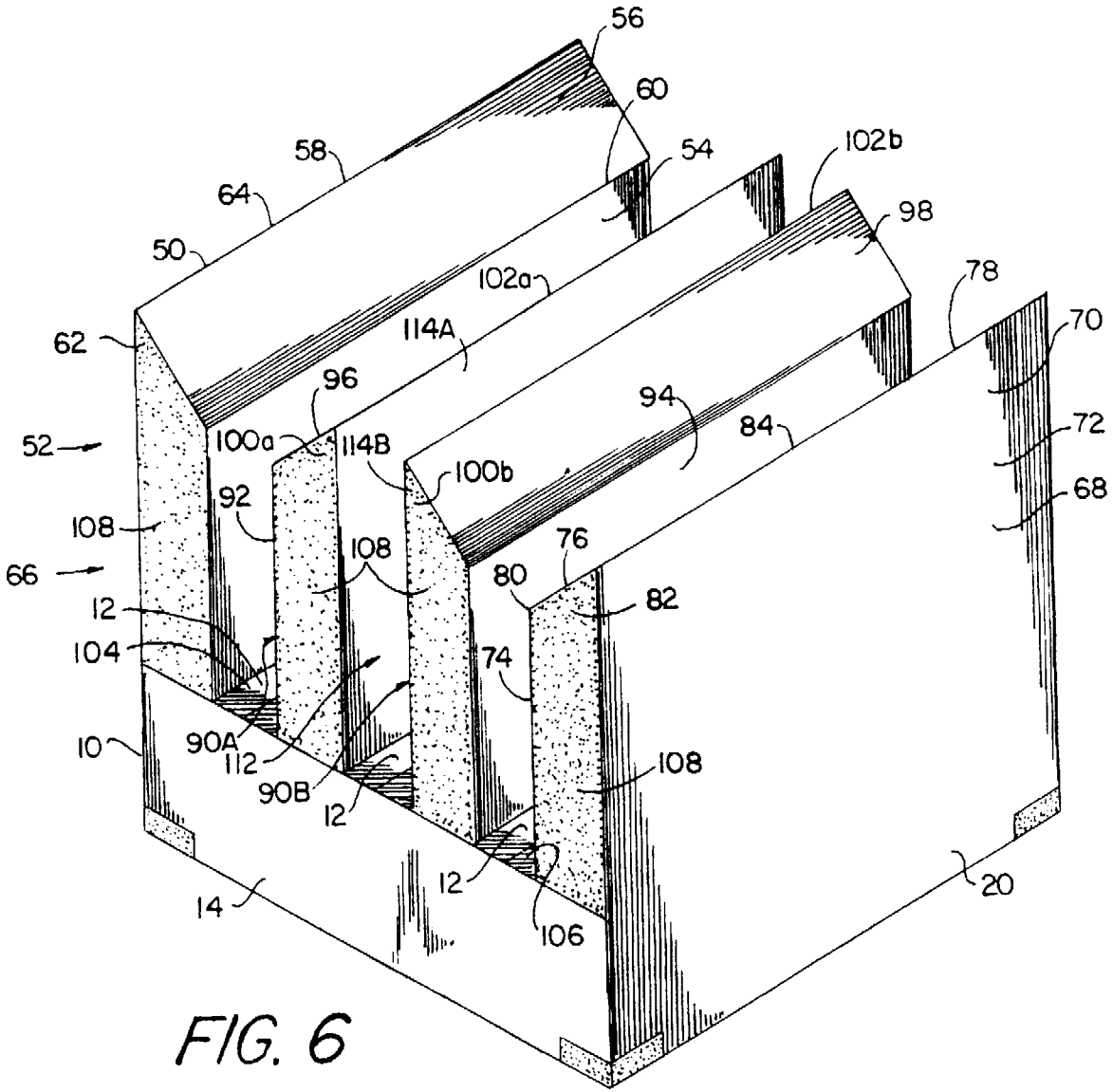

In FIG. 6, there is shown another alternative embodiment in which the central spire is split into two central spires 90A and 90B which define therebetween a third channel 112 and provide two additional flat side walls 114A and 114B respectively of the same perforated sheet material. Otherwise, the embodiment shown in FIG. 5 is as is described above with respect to the embodiment shown in FIG. 1.

In practicing this invention, the perforated sheet metal used for the walls of the anechoic elements may have an open area ranging from as little as about 20% to in excess of 60%, depending on the desired characteristics of the anechoic or hemi-anechoic chambers that are to be constructed. However, where it is desired to produce anechoic or hemi-anechoic chambers having an inverse square law deviation in the range of 1.0 to 1.5 dB, it is preferred to practice the invention by using sheet metal having an open area in the range of about 23% to about 52%, preferably about 23% to about 33%.

There is thus provided a universal acoustic energy absorbing device which, in its various configurations and compositions of material, effectively absorbs acoustic energy and/or radio frequency signals, depending upon the materials and constructions used.

As noted above, the device may be provided with two, three or four spires, separated by one, two and three channels or slots, respectively. While the covering material that forms walls 12, 14, 16, 18, 20, 52, 72, etc. is preferably made of perforated sheet metal, e.g., steel, it should be noted that the covering material may consist of, hardware cloth (wire mesh) or other rigid or stiff perforated material. Also the spires and platform may be filled with a variety of sound absorbing material, as, for example, fiberglass, in bat or loose form, or an open or closed cell foam material such as a polyurethane foam or the like.

The material used in construction of the devices varies with the intended application. For example, an audio acoustic absorber may be constructed of open cell foam cut to shape, or fiberglass, covered with perforated metal or hardware cloth. On the other hand, a device designed to absorb radio-frequency energy may require use of different materials, as suggested by the prior art. In the case of an RF absorbing unit, the platform and each spire is filled with a plastic foam or a fibrous glass, mineral wool, or sheets of conductive carbon (graphite), or else is laminated with intervening perforated sheets of conductive carbon or a composite material loaded with conductive carbon to create integral wave guide attenuating surfaces.

The devices described hereinabove each provide more surface area than the conventional wedge-shaped devices customarily used in the construction of anechoic test chambers. They also have the advantage that they provide more sound absorbing area than the product(s) described in U.S. Pat. No. 5,317,113 issued 31 May 1994 to John Duda for "Anechoic Structural Elements and Chamber".

In FIG. 4, there is shown an illustrative assembly of sound absorption devices of the type shown in FIG. 1. The platform 10 of each device is fixed to a wall 120 of an anechoic chamber (not shown). The chamber may be an anechoic chamber of a hemi-anechoic chamber as defined by the prior art. In this case, the spires 50, 70, 90 extend normally to the wall 120 and inwardly of the chamber of which wall 120 is a part. Each of the devices abuts other similar devices oriented 90° thereto, such that the first and second planar end walls 66, 68 of one device abut the platform first or second side walls 14, 16 of a neighboring device.

As may be seen in FIG. 41 attached to wall 120 are elongated strips or tracks 122 that are used for mounting the sound-absorbing devices. The strips or tracks 122 permit the devices to make a slip connection therewith. If platform 10 is provided with two pairs of opposed flanges, the device may be oriented such that either pair of opposed flanges may be utilized in attaching the device to the wall 120. It will be understood, that by "wall" is meant any exposed surface in the chamber, such as a floor, side wall, ceiling, partition, and the like. Thus, the devices are arranged to create an array 124 (FIG. 6) on each interior surface of an acoustic test chamber. The devices are alternated in their relationship to one another to provide the array 124 in which each device is perpendicular to neighboring devices. The channels and parallel surfaces of each device thereby alternate 90° in relationship to the channels and parallel surfaces of the neighboring devices to more effectively "break-up" and absorb sound waves.

The array 124 offers an exposed surface area having a multiplicity of tapered and alternately parallel and opposed slotted and angled surfaces, which improve absorption of acoustical energy. The array 124 of devices shown and described herein exposes more surface area than arrays of the conventional wedge-shaped devices shown by U.S. Pat. No. 5,317,113, in the construction of anechoic test chambers. Also the invention offers the advantage that the exposed perforated metal surfaces of the anechoic elements can be cleaned with little difficulty while offering mechanical protection and support to the sound-absorbing media 108. Other advantages will be obvious to persons skilled in the art.

It is to be understood that the present invention is by no means limited to the particular constructions herein disclosed an/or shown in the drawings, but also comprises any modifications or equivalents within the scope of the claims. Thus, for example, at least some of the perforated metal walls may be replaced with a metal wire cloth or a perforated plastic sheet material. Still other modifications will be obvious to persons skilled in the art.

The above basic embodiments of the invention, and variations thereof, allow for economic trade-offs in anechoic chamber construction, since the latter may be varied depending on accuracies required in acoustic measurements as well as space availability and utilization considerations.

In any event, and significantly, the subject invention provides anechoic elements which combine the advantages of providing a high degree of sound absorption while also having the sound-absorptive material fully enclosed in a rigid or stiff protective metal covering having an open area that preferably is in the range of 23% to about 52%, more preferably in the range of about 23% to about 33%. Moreover, the anechoic elements provided by this invention provide sound absorption and isolation as good or better than what is achieved with prior devices using perforated metal coverings with like open area, i.e., as good and better than the devices disclosed in U.S. Pat. No. 5,317,113 with less overall depth of treatment to achieve a desired low frequency cutoff.

As indicated hereinabove the perforated covering for the sound absorbing units provide protection against impact, erosion and dirt accumulation. Moreover, a significant advantage of this invention is that it provides improved performance with a shorter length of treatment, i.e., a shorter distance from the supporting wall structure to the innermost portion (peak) of the anechoic element. By way of example, for an optimum cutoff at a ¼ wavelength frequency, the distance between the peak of a conventional wedge-shaped anechoic element and the supporting wall is about 42", whereas for the present invention the same depth of treatment is about 27", with the result that the actual size of the anechoic chamber is substantially reduced while providing essentially the same sound absorbing capability and internal force field dimensions. Normal incidence sound absorption measurements using the impedance tube method demonstrates the superior performance of the new design of this invention. The performance of elements made according to this invention is such that they may be used to construct chambers characterized by a maximum deviation from the inverse square law as little as 1.5 dB and certainly in the range of 1.5 to 3 dB, depending on frequency.

The foregoing description shows only preferred embodiments of the present invention. Therefore, it should be understood that the invention in its broader aspects is not limited to the specific embodiments herein shown and described but departures may be made therefrom within the scope of the accompanying claims without departing from the principles of the invention and without sacrificing its chief advantages.

What is claimed is:

1. An acoustic absorption device comprising:

a platform having a rectangularly-shaped top surface and four side surfaces, each of said surfaces comprising a perforated material; and a plurality of spires upstanding from said top surface, said spires extending from a first to an opposite second of said sides;

a first of said spires having a wall surface comprising a continuation of a third of said platform side surfaces to form a device first planar end; and a second of said spires having a wall surface comprising a continuation of a fourth of said platform side surfaces to form a device second planar end;

said spires being spaced one from another to form a channel between neighboring ones of said spires;

said spires being at least in part covered with the perforated material; and said platform and said spires each housing a body of sound absorbing material.

2. The acoustic absorption device in accordance with claim 1, wherein said first and second spires are each provided with a free end surface, which declines toward said top surface and toward said channel from one of said device planar ends.

3. The acoustic absorption device in accordance with claim 2, wherein said free end surface is covered with said perforated material.

4. The acoustic absorption device in accordance with claim 1, wherein edges of said spires adjacent said platform first and second sides expose surfaces of said sound absorbing material.

5. The acoustic absorption device in accordance with claim 1, wherein at least two of said platform four sides are provided with a flange extending inwardly of said platform to form bottom surfaces for retaining one of said bodies of sound absorbing material in said platform.

6. The acoustic absorption device in accordance with claim 1, wherein said plurality of spires further comprises a central spire disposed between and parallel to said first and second spires.

7. The acoustic absorption device in accordance with claim 2, wherein said plurality of spires further comprises a central spire disposed between and parallel to said first and second spires, a free end surface of said central spire having first and second portions declining from a central ridge toward said first and second spires, respectively, and toward said top surface.

8. The acoustic absorption device in accordance with claim 1 wherein said perforated material is rigid.

9. The acoustic absorption device in accordance with claim 1 wherein said plurality of spires includes a central spire disposed between and extending parallel to said first and second spires and spaced therefrom to define said channel between said central spire and said first spire and a further channel between said central spire and said second spire.

10. The acoustic absorption device in accordance with claim 1 wherein said plurality of spires includes first and second central spires spaced from each other to define one of said channels therebetween, and extending parallel to each other and to said first and second side spires, said first central spire and said first side spire defining therebetween one of said channels, and said second central spire and said second side spire defining therebetween another of said channels.

11. An anechoic chamber according to claim 1 wherein the anechoic device comprises three spires attached to said platform so as to form a 3-dimensional E-shaped sound absorbing element.

12. An acoustic absorption device comprising:

a platform having a rectangularly-shaped top surface and four side surfaces, each of said surfaces comprising a rigid perforated material, said platform having therein a sound absorbing material;

spires upstanding from said top surface and extending from a first of said side surfaces to an opposite second of said side surfaces, a first of said spires being disposed centrally between third and fourth opposite ones of said side surfaces, a second of said spires being disposed proximate said third of said side surfaces, and a third of said spires being disposed proximate said fourth of said side surfaces, said first and second spires being spaced from one another so as to define a first channel therebetween and said first and third spires being spaced from one another so as to define a second channel therebetween;

said spires being made of a stiff or rigid perforated material and said spires enclosing bodies of a sound absorbing material.

13. The acoustic absorption device in accordance with claim 12 wherein a free end of said first spire is provided with a central peak and ridge, and said second and third spires at free ends thereof are each provided with a peak and ridge at a side wall thereof comprising respectively, extensions of said third and fourth side surfaces.

14. The acoustic absorption device in accordance with claim 12 wherein each of said spires comprises at least two planar walls extending at a right angle to the plane of said top surface.

15. An acoustic absorption device comprising:

a platform having a rectangularly-shaped top surface and four side surfaces, each of said surfaces comprising a rigid perforated material, said platform having therein a sound absorbing material, and at least two opposite sides of said platform being provided with a flange extending inwardly of said platform to provide bottom surfaces of said platform, said flanges being adapted for securing said acoustic absorption device to a supporting wall;

spires upstanding from said top surface and extending from a first one of said side surfaces to an opposite second one of said side surfaces, a first one of said spires being disposed centrally between third and fourth opposite ones of said side surfaces, a second one of said spires being disposed proximate said third one of said side surfaces, and a third one of said spires being disposed proximate said fourth one of said side surfaces, said first and second spires defining a first channel therebetween and said first and third spires defining a second channel therebetween;

said spires being at least in part covered with rigid perforated material enclosing bodies of said sound absorbing material.

16. An acoustic absorption device comprising:

a platform having a rectangularly-shaped top surface and four side surfaces, each of said side surfaces comprising a perforated sheet of rigid material, at least an opposed two of said sheets having flange portions at a bottom edge thereof extending inwardly of said platform, and a sound-absorbing material disposed in said platform and retained by said flange portions in a chamber formed by said top surface and said side surfaces;

a central spire upstanding from said top surface and having parallel side walls of perforated sheets of rigid material, and two slanted end walls of perforated material at a free end of said spire joining to form a central peak and ridge;

a first side spire upstanding from said top surface, an outer end side wall of said first side spire comprising a continuation of one of said platform side walls, an inner side wall of said first side spire being a perforated sheet of said rigid material, and a free end surface declining from a free end of said outer end side wall inwardly toward said central spire and toward said platform top surface to join a free end of said first side spire inner side wall, thereby defining a peak and ridge at said free end of said first side spire outer side wall;

and a second side spire upstanding from said top surface, an outer end side wall of said second side spire comprising a continuation of an opposite one of said platform side walls, an inner side wall of said second side spire being a perforated sheet of said rigid material, and a free end surface declining from a free end of said second spire outer end side wall inwardly toward said central spire and toward said platform top surface to join a free end of said second side spire inner side wall thereby defining a peak and ridge at said free end of said second side spire outer side wall;

said central spire being spaced from said first and second side spires to define first and second channels respectively therebetween, said channels having therein floors of said rigid perforated material;

said spires each having therein a sound absorptive material.

17. An assembly of acoustic absorption devices, each of said devices comprising a platform having a rectangularly-shaped top surface and four side surfaces, each of said surfaces comprising a perforated material, and a plurality of spires upstanding from said top surface, said spires extending from a first to an opposite second of said sides, a first of said spires having a wall surface comprising a continuation of a third of said platform side surfaces, to form a device first planar end and a second of said spires having a wall surface comprising a continuation of a fourth of said platform side surfaces to form a device second planar end, said spires being spaced one from another to form a channel therebetween; said spires being at least in part covered with the perforated material, said platform and said spires each housing a body of sound absorbing material;

a wall for supporting a multiplicity of said devices;

said devices being arranged on said wall with the platforms thereof adjacent said wall and the spires extending normal to said wall, with a first device first and second planar ends each abutting one of said first and second sides of another of said devices, and with the first device first and second sides each abutting one of said device first and second planar ends of another of said devices.

18. A substantially enclosed sound absorbing device for an anechoic chamber which provides a maximum deviation from the inverse square law of about 1.5 dB, said device having a 3-dimensional "E" shape and comprising a base and a plurality of mutually spaced spires projecting from said base, each of said spires comprising two spaced apart planar sound transparent wall members and a body of sound absorbing material disposed between said wall members, said side wall members extending substantially at a right angle to said base, said two wall members having outer ends remote from said base that are connected by at least one sloping end wall, said two wall members and said at least one sloping end wall defining a trapezoidally-shaped enclosure that is filled with said body of sound absorbing material;

said wall members and said at least one sloping end wall member comprising a sheet material that has perforations, with said perforations forming a free space that is at least about 20% of the total area of said wall members.

19. An anechoic chamber comprising a wall that presents an exposed surface, and a plurality of anechoic devices mounted to said exposed surface, each of said anechoic devices comprising:

a platform mounted to said exposed surface of said chamber wall;

at least a pair of spires attached to and extending away from said platform, each of said spires comprising a pair of parallel spaced apart sound transparent side wall members and a body of sound absorbing material disposed between said side wall members, said side wall members being flat and extending substantially at a right angle to said platform, said side wall members having outer ends remote from said platform that are connected by a sloping end wall, said side wall members and said at least one sloping end wall defining an enclosure that is filled with said body of sound absorbing material;

said side wall members and said at least one sloping end wall member comprising a sheet material that has perforations, with said perforations forming a free space that is at least about 20% of the total area of said wall members.

20. An acoustic absorption device comprising:

a base comprising four rectangular side walls arranged in a rectangle so as to define a volume in the shape of a right parallelepiped;

at least first and second mutually-spaced spires attached to and extending away from said base, each of said spires comprising first and second flat spaced apart rectangular sound-transparent side wall members and a sound-transparent end wall member; said first and second side wall members extending substantially parallel to first and second opposite ones of said side walls and having outer ends remote from said base, with the outer end of said first wall member being further from said base than the outer end of said second wall member, and said end wall member being connected to said to and extending between said outer ends; and a body of sound absorbing material filling the interior space of each spire between said side wall members and said end wall member.

21. An acoustic absorption device according to claim 20 wherein said the right parallelepiped volume of said base is filled with a sound absorbing material.

22. An acoustic absorption device according to claim 20 wherein said first wall member of said first spire is a planar extension of said first one of said opposite side walls, and said first wall member of said second spire is a planar extension of the second one of said opposite side walls.

23. An acoustic absorption device according to claim 20 comprising a third spire attached to said base between and spaced from said first and second spires, said third spire comprising first and second flat spaced apart rectangular sound-transparent side wall members and first and second sound-transparent end wall members, said first and second side wall members of said third spire extending substantially parallel to said first and second side wall members of said first and second spires, and said first and second end wall members of said third spire being connected to each other and also being connected to and extending between said outer ends of said first and second side wall members respectively of said third spire, with said first and second side wall members of said third spire sloping from a central ridge toward said first and second side wall members of said third spire and also toward said base; and further including a body of sound absorbing material filling the interior space of said third spire.

24. An acoustic absorption device according to claim 23 wherein said first wall member of said first spire is a planar extension of said first one of said opposite side walls, and said first wall member of said second spire is a planar extension of the second one of said opposite side walls.

25. An acoustic absorption device according to claim 20 wherein said four walls of said base and said side and end wall members of said spires are made of a material from the class consisting of perforated sheet metal or hardware cloth.

26. An acoustic absorption device according to claim 20 wherein said side and end wall members are made of sheet metal with perforations, said perforations forming a free space that is at least about 20% of the total area of said side and end wall members.

* * * * *

UNITED STATES PATENT AND TRADEMARK OFFICE

CERTIFICATE OF CORRECTION

PATENT NO. : 5,780,785

DATED : July 14, 1998

INVENTOR(S) : Alan Eckel

It is certified that error appears in the above-identified patent and that said Letters Patent is hereby corrected as shown below:

Claim 20, column 12, line 9, after the word "to" (first occurrence), delete the words -- said to --;

Claim 21, column 12, line 15, delete the word "the".

Signed and Sealed this

Twenty-ninth Day of September, 1998

Bruce Lehman

*Attest:*

BRUCE LEHMAN

*Attesting Officer*

*Commissioner of Patents and Trademarks*